US005842913A

United States Patent [19]

Nemazi

[11] Patent Number: 5,842,913

[45] Date of Patent: Dec. 1, 1998

[54] ROTARY DRUM SANDER

[75] Inventor: John E. Nemazi, Bloomfield Hills, Mich.

[73] Assignee: Ryobi North America

[21] Appl. No.: 571,525

[22] Filed: Dec. 13, 1995

[51] Int. Cl.[6] ..... B24B 45/00

[52] U.S. Cl. ..... 451/499; 451/496; 451/500

[58] Field of Search ..... 451/496, 497, 451/499, 500, 513

[56] References Cited

U.S. PATENT DOCUMENTS

| | | | |
|---|---|---|---|
| 948,157 | 2/1910 | Bevan | 451/499 |
| 2,278,564 | 4/1942 | Reid . | |
| 2,870,581 | 1/1959 | Lyon . | |
| 4,720,940 | 1/1988 | Green . | |
| 5,117,592 | 6/1992 | Preston | 451/496 |
| 5,181,347 | 1/1993 | Green . | |
| 5,439,410 | 8/1995 | Larsson | 451/500 |

OTHER PUBLICATIONS

Woodmaster Tools, Inc. Advertisement (folded flyer) (circa 1994).

Performax Products, Inc. Operating Instructions for 16–32 Drum Sander (circa 1994).

*Primary Examiner*—Eileen P. Morgan
*Attorney, Agent, or Firm*—Brooks & Kushman P.C.

[57] ABSTRACT

A rotary drum sander is provided with a horizontal boom orienting a rotatable cylindrical drum to cover the spirally wound strip of abrasive material above a work supporting platen. The abrasive material is affixed to the drum by a first and second anchor, the second anchor is pivotally mounted relative to the drum and rotatably biased by a spring to cause the second anchor to rotate relative to the drum to maintain tension in the abrasive strip as the abrasive strip stretches during use.

20 Claims, 3 Drawing Sheets

ROTARY DRUM SANDER

TECHNICAL FIELD

This invention relates to rotary drum sanders used in bench top or table mounted woodworking machines.

BACKGROUND ART

Rotary drum sanders from a bench top or table mounted design are used to sand wooden boards to achieve a flat smooth planar surface. Drum sanders are typically provided with a lower platen for supporting a work piece below a rotating drum covered with abrasive material. A drive mechanism, such as a feedroll or a conveyor belt feeds the work piece through the machine at a constant rate. A number of various rotary drum sander embodiments are manufactured and sold by WoodMaster Tools, Inc. and Performax Products, Inc. Rotary drum sanders are of two general constructions: a type having the drum pivotally affixed to a boom attached to the frame at both axial ends as shown in U.S. Pat. No. 5,181,347; and, a rotary drum sander having the rotary drum supported on a cantilevered boom such as the sander illustrated in U.S. Pat. No. 4,720,940.

Rotary drum sanders having a drum boom fixed at both ends have the advantage of structural rigidity, particularly when long-sanding drums are utilized. When the drum boom is supported at both ends, it can be precisely located relative to the lower platen and a heavier cut can be made without achieving unacceptable frame flexing. Cantilevered drum boom designs are ideally suited for home workshops where machine size and cost are significant factors. By utilizing a cantilevered drum design, a 16-inch drum can sand a 32-inch door passing the door through the machine twice. Lighter cuts, of course, must be taken in order to avoid frame flexing when wide boards are being sanded.

Sandpaper is typically mounted on the peripheral surface of rotary drum by winding an elongated strip spirally around the drum. Since it is necessary to frequently change sandpaper from rough to fine grit paper as one progressively sands a board smoother and smoother, it is necessary to have the sandpaper removably attached to the drum periphery. Several different attachment schemes have been used in the prior art. The 4,720,940 patent illustrates a simple clip mechanism which fixes opposed ends of the sandpaper to the drum at a fixed position. Since the paper is only attached at the ends, as the paper stretches during use, it is necessary to frequently retighten the paper in order to maintain paper tightly wound around the drum periphery. U.S. Pat. No. 5,181,347 illustrates a spring biased clamp used to fix one end of the paper to the drum. As the paper stretches, the spring bias clamp which is pivotally mounted to the drum periphery pivots inwardly, pulling the paper taut. However, due to the limited space between the drum periphery and the central hub, travel is limited and the radially inward movement of the clamp prohibits the drum from being balanced at all times.

Another method of affixing the sandpaper to the drum periphery is utilized by WoodMaster Inc., wherein the drum is coated with a Velcro™ fastener and a back side of the elongated strip of sandpaper is coated with a corresponding Velcro™ fastener. By supporting the elongated strip of sandpaper throughout its entire length, belt elongation is minimized and the cumulative effects of belt stretching are not experienced in one end of the belt as is the case when the sandpaper is only affixed at two extreme ends.

SUMMARY OF THE INVENTION

The object of the present invention is to provide a mechanism for affixing the sandpaper to the outer periphery of the drum in a rotary sander so the elongated strip of sandpaper is maintained tightly wound around the drum.

Another object of the invention is to provide a sandpaper drum which is balanced at all times regardless of the amount of stretch in the sandpaper spirally wound about the drum.

Another object of the present invention is to provide a rotary drum sander which utilizes a conventional elongated strip of sandpaper without the need for expensive Velcro™ or adhesive attachment on the sandpaper back.

Accordingly, a rotary drum sander is provided having a frame and a lower platen and a horizontal boom vertically adjustable relative the lower platen. A cylindrical drum is pivotally supported upon the horizontal boom rotatable by the drum axle by a drive motor. The drum is provided with first and second abrasive anchors oriented at opposite ends of the cylindrical drum for retaining an elongated strip of abrasive material wound spirally around the drum. One of the abrasive anchors is pivotally rotatable relative to the drum for anchoring the elongated strip of abrasive material to the anchor at a location spaced radially from the drum axis. A spring biases the drum anchor relative to the drum to tighten the elongated strip of abrasive material about the drum periphery as the abrasive material stretches. Preferably, the rotatable abrasive anchor is balanced relative to the drum axis so that the drum and the abrasive anchor assembly will remain balanced as the elongated strip of abrasive material stretches.

The above objects and other features and advantages of the present invention will be readily apparent from the following detailed description of the best mode for carrying out the invention when taken in conjunction with the accompanying drawings.

BEST MODE FOR CARRYING OUT THE INVENTION

Figure 1:
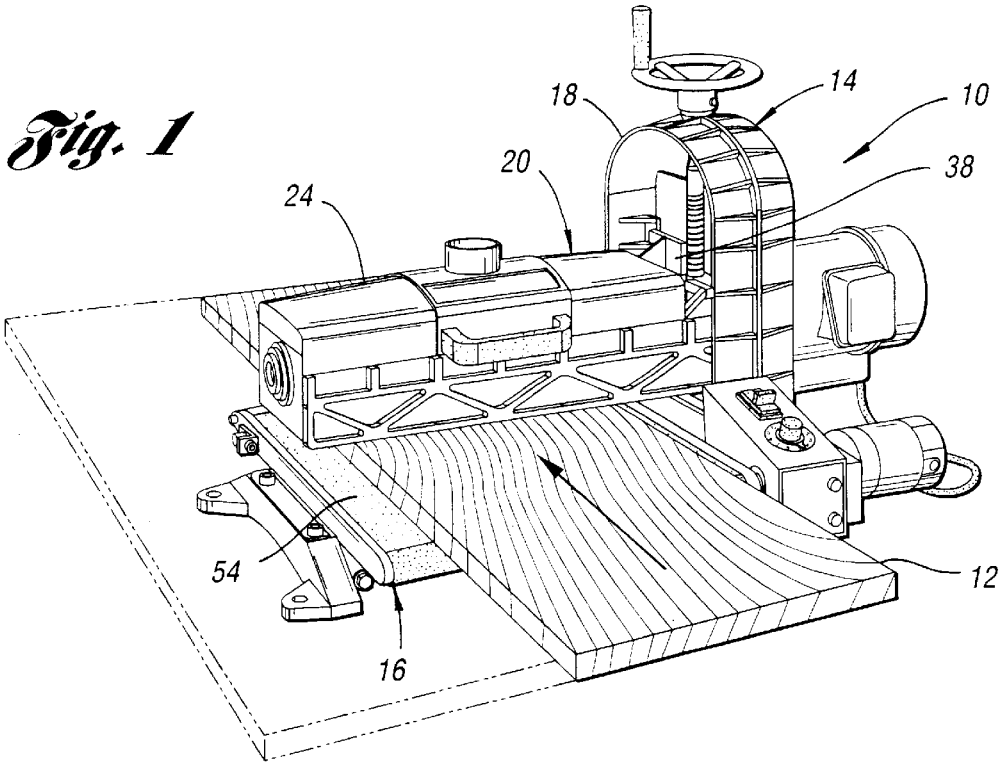
FIG. 1 is a perspective view of a rotary drum sander of the present invention sanding an elongated board.

Referring to FIG. 1, rotary drum sander 10 is shown sanding the upper surface of wooden board 12 moving through the rotary drum sander in the direction of the arrow. Rotary drum sander 10 is of the cantilevered boom design having a frame 14 made up of a lower platen 16, vertical member 18 and horizontal boom 20 vertically adjustable relative to platen 16. Oriented within the horizontal boom is a rotary drum 22 which is obscured from view by dust cover 24. Rotary drum 22, illustrated in detail in FIG. 6, has a cylindrical wall 26 defining a circular cylindrical outer periphery supported on an axial shaft 28. Shaft 28 is pivotally supported on horizontal boom 20 by a pair of bearing assemblies 30 and 32, respectively located on the free end 34 of the boom and the fixed end 36 of the boom.

Figure 6:
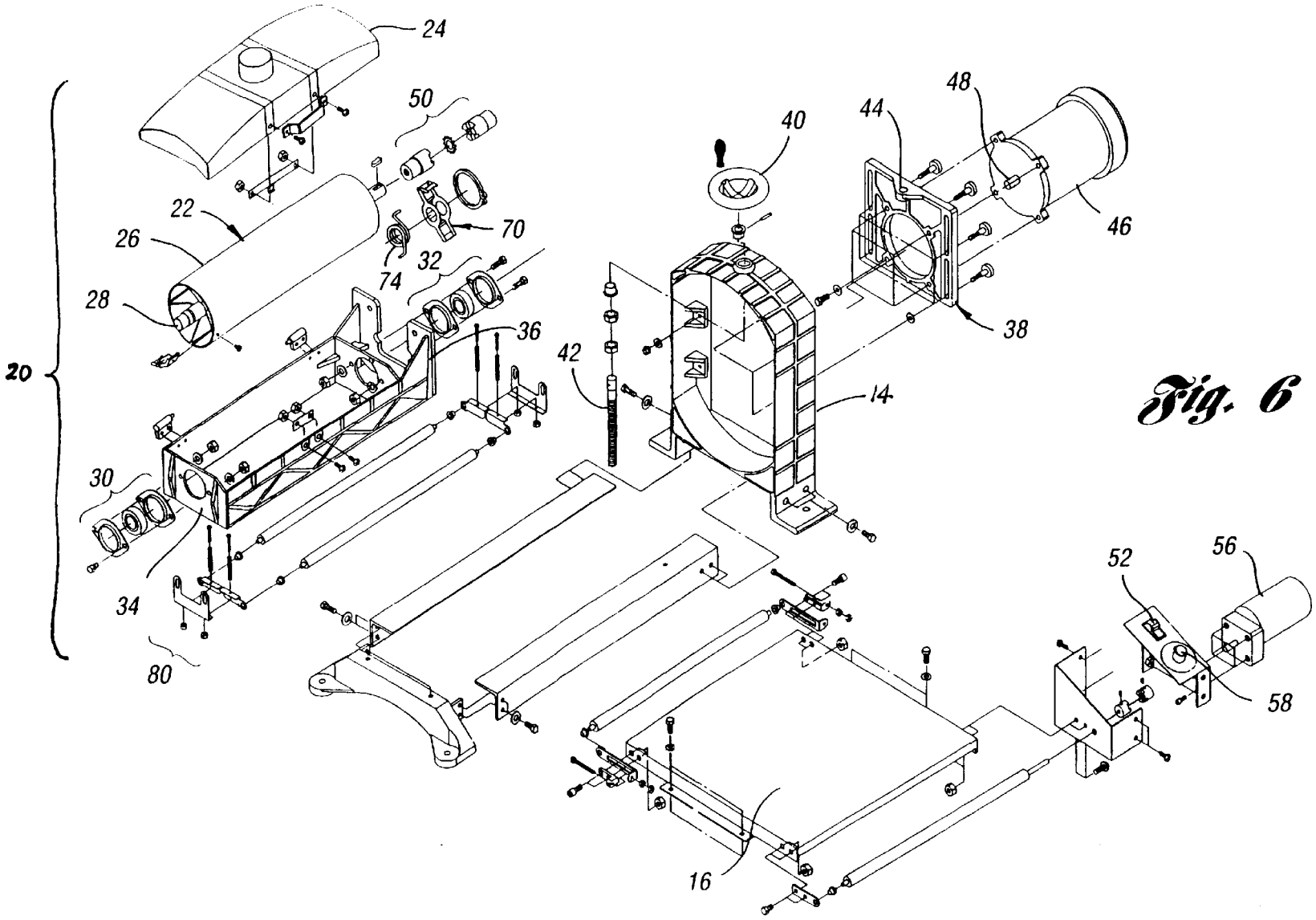
FIG. 6 is an exploded detail perspective view of the individual components which make up the rotary drum sander.

As illustrated in FIG. 6, horizontal boom 20 is generally rectangular in shape having an open top and bottom. A free end 34 cooperating with bearing assembly 30 and a fixed end 36 cooperating with bearing assembly 32 and attached to motor mounting plate 38. Motor mounting plate 38 is slidably mounted to frame 14 so that the motor mounting plate can be vertically adjusted by a height adjustment handle 40. The height adjustment handle 40 rotates lead screw 42 which engages threaded boss 44 in mounting plate 38. Motor 46 is affixed to motor mounting plate 38 and has a rotary output shaft 48 projecting through a central boring motor mounting plate 38. Motor output shaft 48 is connected to rotary drum 26 via a conventional drive coupling 50 which accommodates minor misalignment between the motor output shaft 48 and the rotational axis of drum shaft 28.

In operation, the operator will adjust handle 40 until the lower surface of cylindrical drum 22 is spaced above a lower platen 16, a distance selected to take an initial sanding cut on the upper surface of wooden board 12. Power switch 52 is then turned on, causing motor 46 to be powered, rotating drum 22 in a counterclockwise direction when viewing the drum from the boom free end 34. In the preferred embodiment illustrated a motorized conveyor 54 is mounted upon the lower platen 16 and driven by conveyor motor 56. Rheostat 58 regulates conveyor speed. Power switch 52 also supplies power to conveyor motor 56. Once the drum motor 46 and conveyor motor 56 are both operational, the operator will set the desired feed speed with rheostat 58 whereupon board 12 will be fed through the rotary drum sander to have the upper surface of the board sanded by an elongated strip of abrasive material 60 which is wound about the rotary drum.

Figure 2A:
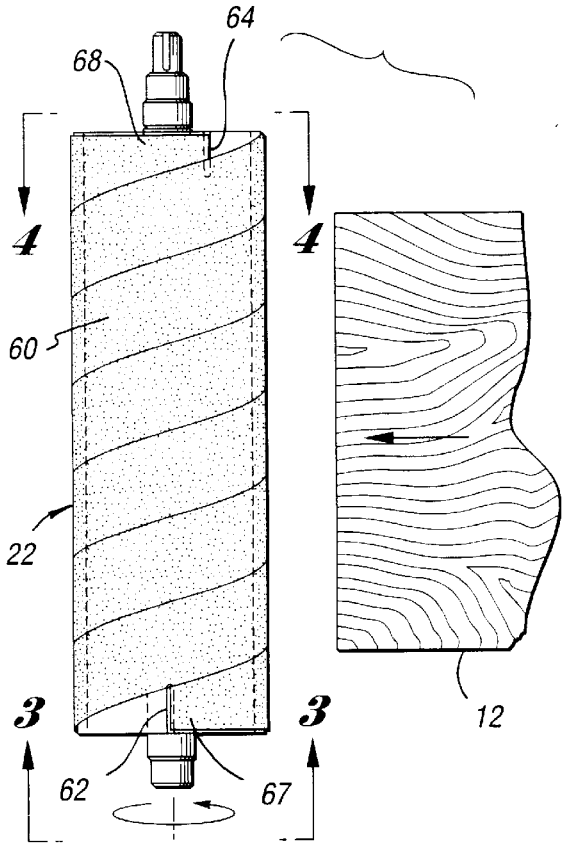
FIG. 2*a* is a plan view of a cylindrical drum covered with a spirally wound strip of abrasive material.
Figure 2B:
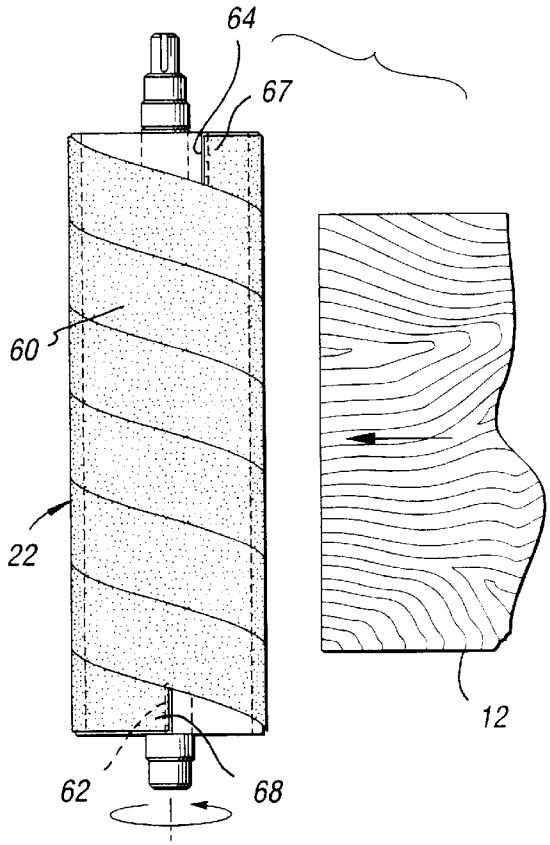
FIG. 2*b* is an alternative orientation of the spirally wound strip of abrasive material.
Figure 3:
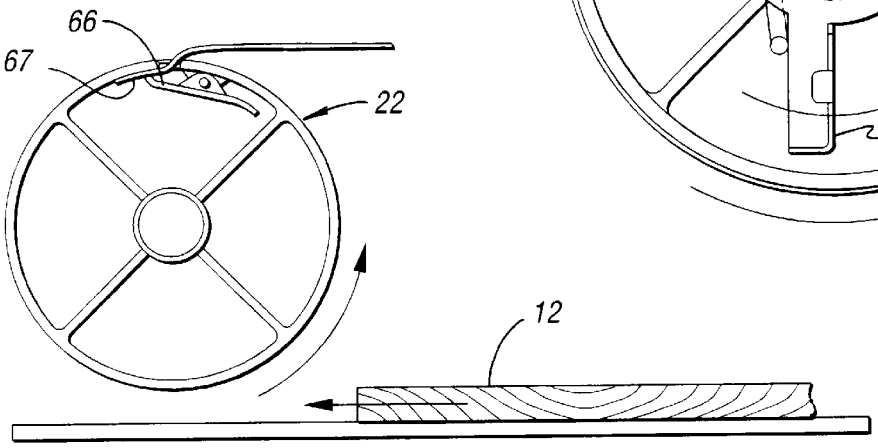
FIG. 3 is an end view of the cylindrical drum taken along line 3—3 of FIG. 2*a;*

Once the upper surface of board 12 is sanded, the opposite surface can then be sanded by turning the board over and adjusting handle 40 to lower boom 20 slightly to accommodate the change in board thickness. Once both sides of board 12 are sanded with the selected abrasive material, it is frequently desired to take a second sanding pass utilizing a finer abrasive material thereby necessitating the removal of the strip of elongated abrasive material 60 and installing a finer grit material. The elongated strip of abrasive material 60 is shown wound about the rotary drum 22 in FIG. 2*a* and in FIG. 5. The elongated strip of abrasive material is wound in a spiral manner and is anchored to the drum 22. Each end of the drum is provided with a longitudinal slot 62 and 64 as illustrated FIGS. 2*a*–5. Slots 62 and 64 are sufficiently wide to enable the elongated strip of abrasive material to pass through the drum wall into the interior of cylindrical drum 22, as illustrated in FIG. 3. The first abrasive anchor 66 serves to releasably clamp an end of an elongated strip of abrasive material 60 securely to the drum with a first end 67 of the elongated strip of abrasive material 60 retained by first anchor 66. Drum 22 is then rotated by hand causing the elongated strip of abrasive material to be spirally wound about the outer periphery of the drum as shown in FIG. 2*a* and 2*b*. The opposite second end 68 of the elongated strip of abrasive material 60 is then threaded through slot 64 and attached to second abrasive anchor 70.

Figure 4:
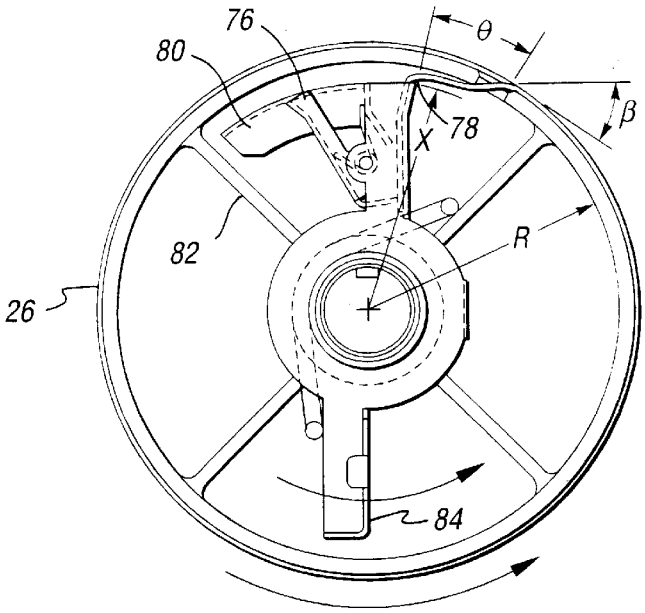
FIG. 4 is an end view of the cylindrical drum taken along the line 4—4 of FIG. 2*a;*
Figure 5:
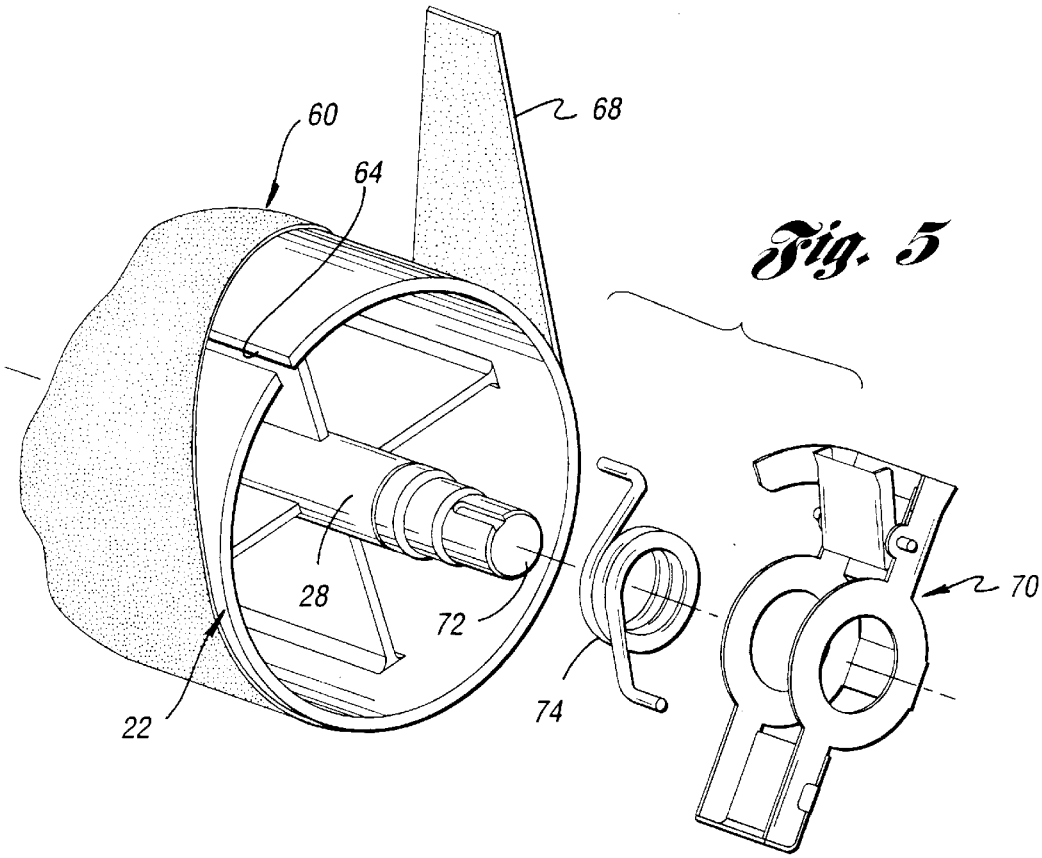
FIG. 5 is an exploded perspective view of the cylindrical drum, elongated abrasive strip and second abrasive anchor.

Second abrasive anchor 70 is pivotally mounted upon shaft 28 of cylindrical drum 22 and free to rotate relative thereto about the drum axis 72. A spring 74 is provided for rotationally biasing second anchor 70 relative to drum 22 in order to maintain tension on the second end 68 of the elongated strip of abrasive material 60. As illustrated in FIG. 4, second anchor 70 is biased in a counterclockwise direction relative to drum 22 causing the elongated strip of abrasive material to be pulled through slot 64. In operation, as the elongated strip of abrasive material stretches, second anchor 70 will maintain the elongated strip of abrasive material taut at all times.

Second anchor 70 can be balanced relative to drum axis 72 so that the relative movement of second anchor 70 with respect to drum 22 does not cause the rotating mass to become imbalanced. Another significant advantage of the design of the second abrasive anchor results from the direction the second abrasive anchor pulls the second end 68 of the elongated strip of abrasive material 60 with respect to slot 64. In operation, the operator will rotate second anchor 70 relative to drum 22 to orient clamp 76 formed on an end of second abrasive anchor immediately radially inboard of slot 64. The operator will then thread the second end 68 of the elongated strip of abrasive material 60 through slot 64 and affix second end 68 to second anchor 70 with clamp 76. Once end 68 is clamped to second anchor 70, the operator releases second anchor 70 allowing spring 74 to rotate second anchor 70 relative to drum 22 to take up the slack in the elongated strip of abrasive material. The elongated strip of abrasive material extending between slot 64 forms an angle $\beta$ which is preferably less than 30° when the initial point of engagement 68 is rotated through angle $\theta$ resulting from the slack being taken up. As the elongated strip of abrasive material 60 stretches during use, second anchor 70 rotates counterclockwise relative to drum 22 causing the angle $\theta$ to increase. In the preferred embodiment with a 16-inch long, 5-inch diameter drum, a 3-inch wide 90-inch long strip of abrasive material is used which can stretch as much as an inch in normal use. In the preferred embodiment, second anchor 70 is provided with at least 30° of travel beyond the point at which initial slack is taken up as illustrated in FIG. 4. In order to prevent excessive rotation of second anchor 70 relative to drum 22 when the elongated strip of abrasive material is being changed, a stop 80 is provided for engaging rib 82 to limit the maximum relative movement between second anchor 70 and drum 22.

In order to achieve rotary balance, the second anchor 70 is provide with a balance portion 84 located generally diametrically opposite to clamp 76. It should be appreciated that stop 80 could alternatively be positioned upon balance portion 84.

In order to better enable second anchor 70 to pull the second end 68 of the elongated strip of abrasive material through the slot 64, the point of initial engagement 78 is located at a distance X relative to drum radius R. Where X is greater than 0.5 R, and preferably in a range between 0.8 R and 0.95 R. This geometric orientation enables angle $\beta$ to be minimized while still providing adequate clearance to thread the second end 68 of the elongated strip of abrasive material through slot 64 and to engagement with clamp 76.

Spring 74 is preferably a torsionally wound coil spring having at least three turns and deformed at least 180° from its free state when the second anchor 70 is rotated so that engagement point 78 is directly radially inboard of slot 64. By having a relatively high amount of torsional deformation of spring 74 relative to the travel of the second anchor 70, the spring force, which is a function of the spring constant times the torsional deformation can be maintained relatively uniform during operation. It should also be noted that the centrifugal load caused by the rotation of the second anchor 70 about axis 72 is transmitted directly through the body of the second anchor and not transmitted through spring 74.

Therefore, the spring force of the present invention can be lower than the prior art making the abrasive material changing process easier for the operator.

In the embodiment of the drum sander illustrated in FIGS. 2*a* and 3–6, fixed anchor 66 is oriented adjacent free end 34 of boom 20 and the second anchor 70 is oriented adjacent fixed end 36 of boom 20. It should be appreciated, however, that by wrapping the elongated strip of abrasive material differently as shown in FIG. 2*b*, fixed anchor 66 could be located adjacent boom fixed end 36 and the second anchor 70 would be located at the opposite end adjacent boom free end 34.

It should similarly be noted that the novel drum and anchor assembly of the present invention is equally applicable to rotary drum sanders having the horizontal boom affixed at two ends as opposed to the cantilevered boom design illustrated. The preferred embodiment of the rotary drum sander 10 illustrated in FIG. 6 is just one preferred example of the rotary drum sander which could incorporate the novel features of the present invention. Design features such as the guide roll assembly 80 having a pair of spring biased guide rollers to maintain board 12 into engagement with the lower platen or conveyor assembly 54 mounted on lower platen for feeding board 12 through the drum sander could be modified or eliminated for cost-reduction purposes. Similarly, a double cylindrical drum tool of the type used in commercial sander machines could be built utilizing the present invention.

It is also understood, of course, that while the form of the invention herein shown and described constitutes a preferred embodiment of the invention, it is not intended to illustrate all possible forms thereof. It should also be understood that the words used in the specification are words of description rather than limitation and various changes may be made without departing from the spirit and scope of the invention.

What is claimed is:

1. A rotary drum sander comprising:

a frame having a lower platen, at least one vertical member, and a horizontal boom cooperating with the at least one vertical member, the boom being vertically adjustable relative to the platen;

a circular cylindrical drum have an axial shaft; the drum being pivotably supported upon the horizontal boom and rotatable about a generally horizontal drum axis, the cylindrical drum having opposed ends and a cylindrical outer periphery for supporting an elongated strip of abrasive material which is spirally wound thereabout;

a drive motor operatively connected to the cylindrical drum to rotate the drum relative to the frame;

first and second abrasive anchors cooperating with the opposed ends of the cylindrical drum for affixing the ends of the elongated strip of abrasive material about the drum, wherein the second abrasive anchor is pivotably mounted on the axial shaft and rotatable relative the cylindrical drum about the drum axis and provided with a clamp for releasably affixing an end of the elongated strip of abrasive material to the second anchor at a location spaced radially from the drum axis; and a spring cooperating with the cylindrical drum and the second abrasive anchor to urge the second abrasive anchor to rotate relative to the cylindrical drum about the drum axis in a direction to continuously tighten the elongated strip of abrasive material about the periphery of the cylindrical drum, maintaining the elongated strip of abrasive material taut when it stretches during use.

2. The rotary drum sander of claim 1 wherein the second abrasive anchor is provided with a balanced portion generally diametrically opposed to the clamp.

3. The rotary drum sander of claim 2 wherein the second abrasive anchor is balanced when rotated about the drum axis.

4. The rotary drum sander of claim 1 wherein the spring further comprises a torsional coil spring having a central axis aligned generally coaxially with the drum axis.

5. The rotary drum sander of claim 1 wherein the second abrasive anchor engages the elongated strip of abrasive material at an initial engagement point radially spaced a distance X from the drum axis where the distance X is maintained constant as the second abrasive anchor rotates relative to the cylindrical drum to minimize bending of the abrasive material passing through the slot.

6. The rotary drum sander of claim 5 wherein the cylindrical drum has a radius R, where X is less than R and greater than 0.5 R.

7. The rotary drum sander of claim 6 wherein X is less than 0.95 R and greater than 0.8 R.

8. The rotary drum sander of claim 1 wherein the cylindrical drum is provided with a pair of longitudinal slots respectively located at opposed ends of the cylindrical outer periphery of the cylindrical drum, the slots being sized to enable the ends of the elongated strip of abrasive material to pass therethrough.

9. The rotary drum sander of claim 8 wherein the first and second abrasive anchors are located radially inboard of the cylindrical drum outer periphery and axially inboard of the cylindrical drum opposed ends to balance the rotational mass of the drum.

10. The rotary drum sander of claim 9 wherein the first abrasive anchor affixes one end of the elongated strip of abrasive material to the cylindrical drum at a fixed position and the second abrasive anchor engages the elongated strip of abrasive material at an engagement point spaced from the drum axis a distance X where X is less than the drum radius R and greater than 0.8 R, causing the angle $\beta$ of the strip of abrasive material extending between the second abrasive anchor engagement point and the longitudinal slot to be less than 30 degrees relative to a line drawn tangent to the cylindrical drum at the longitudinal slot when the second abrasive anchor is rotated 20 degrees from the longitudinal slot, to minimize bending of the elongated strip of abrasive material passing through the slot.

11. The rotary drum sander of claim 1 wherein the second abrasive anchor is provided with a stop for engaging the cylindrical drum limiting the maximum relative rotation therebetween.

12. The rotary drum sander of claim 1 wherein there is only one vertical member and the horizontal boom extends from the vertical member in a cantilevered manner.

13. A drum assembly for a rotary drum sander comprising:

an axial shaft;

a circular cylindrical drum concentrically affixed to the axial shaft and rotatable therewith about a shaft axis, the cylindrical drum having opposed ends and a cylindrical outer peripheral wall for supporting an elongated strip of abrasive material wound thereabout, the cylindrical drum outer peripheral wall having a slot oriented at each opposed end thereof sized to enable the elongated strip of abrasive material to pass therethrough;

first and second abrasive anchors cooperating with the cylindrical drum and oriented radially inboard of the cylindrical drum outer periphery and axially inboard of the cylindrical drum opposed ends for affixing the ends of the elongated strip of abrasive material once wound about a cylindrical drum and pass through the pair of slots, wherein the second abrasive anchor is pivotably mounted on the axial shaft and rotatable relative the cylindrical drum about the drum axis and provided with a clamp for releasably affixing an end of the elongated strip of abrasive material to the second anchor at a location spaced radially from the drum axis; and a spring cooperating with the cylindrical drum and the second abrasive anchor to urge the second abrasive anchor to rotate relative to the cylindrical drum about the drum axis in a direction to continuously tighten the elongated strip of abrasive material about the periphery of the cylindrical drum, maintaining the elongated strip of abrasive material taut when it stretches during use.

14. The drum assembly of claim 13 wherein the spring further comprises a torsional coil spring having a central axis aligned generally coaxially with the drum axis.

15. The drum assembly of claim 13 wherein the second abrasive anchor engages the elongated strip of abrasive material at an initial engagement point radially spaced a distance X from the drum axis where the distance X is maintained constant as the second abrasive anchor rotates relative to the cylindrical drum to minimize bending of the abrasive material passing through the slot, wherein X is less than 0.95 R and greater than 0.8 R.

16. The drum assembly of claim 13 wherein the second abrasive anchor is provided with a stop for engaging the cylindrical drum limiting the maximum relative rotation therebetween.

17. The drum assembly of claim 13 wherein the second abrasive anchor is balanced when rotated about the drum axis.

18. A rotary drum sander comprising:

a frame having a lower platen and a horizontal boom spaced thereabove vertically adjustable relative to the lower platen to vary the distance therebetween;

a circular cylindrical drum pivotally supported upon the horizontal boom and rotatable about a generally horizontal drum axis, the cylindrical drum having a central axial shaft, a cylindrical drum wall concentrically affixed to the axial shaft and rotatable therewith about a shaft axis, the cylindrical drum having opposed ends and a cylindrical outer peripheral wall for supporting an elongated strip of abrasive material wound thereabout, the cylindrical drum outer peripheral wall having a slot oriented at each opposed end thereof sized to enable the elongated strip of abrasive material to pass therethrough;

first and second abrasive anchors cooperating with the cylindrical drum and oriented radially inboard of the cylindrical drum outer periphery and axially inboard of the cylindrical drum opposed ends to balance the rotational mass of the drum, the anchors affixing the ends of the elongated strip of abrasive material once wound about a cylindrical drum and passing through the pair of slots, wherein the second abrasive anchor is pivotably mounted on the axial shaft and rotatable relative the cylindrical drum about the drum axis and provided with a clamp for releasably affixing an end of the elongated sheet of abrasive material to the second anchor at a location spaced radially from the drum axis; and a torsional spring cooperating with the cylindrical drum and the second abrasive anchor to urge the second abrasive anchor to rotate relative to the cylindrical drum about the drum axis in a direction to continuously tighten the elongated strip of abrasive material about the periphery of the cylindrical drum, maintaining the elongated strip of abrasive material taut when it stretches during use.

19. The rotary drum sander of claim 18 wherein the first abrasive anchor affixes one end of the elongated strip of abrasive material to the cylindrical drum at a fixed position and the second abrasive anchor engages the elongated strip of abrasive material at an engagement point spaced from the drum axis a distance X where X is less than the drum radius R and greater than 0.8 R, causing the angle $\beta$ of the strip of abrasive material extending between the second abrasive anchor engagement point and the longitudinal slot to be less than 30 degrees relative to a line drawn tangent to the cylindrical drum at the longitudinal slot when a second abrasive anchor is rotated 20 degrees from the longitudinal slot, thereby minimizing the bending of the elongated strip of abrasive material passing through the slot.

20. The rotary drum sander of claim 18 wherein the second abrasive anchor is provided with a stop for engaging the cylindrical drum limiting the maximum relative rotation therebetween.

* * * * *